US008378953B2

(12) United States Patent
Cheon et al.

(10) Patent No.: US 8,378,953 B2
(45) **Date of Patent: *Feb. 19, 2013**

(54) DISPLAY DEVICE COMPENSATING PRIMARY IMAGE DATA TO INCREASE A RESPONSE SPEED OF THE DISPLAY

(75) Inventors: Man-Bok Cheon, Yongin-si (KR); Hyun-Sang Cho, Suwon-si (KR)

(73) Assignee: Samsung Display Co., Ltd. (KR)

( * ) Notice: Subject to any disclaimer, the term of this patent is extended or adjusted under 35 U.S.C. 154(b) by 1295 days.

This patent is subject to a terminal disclaimer.

(21) Appl. No.: 12/105,139

(22) Filed: Apr. 17, 2008

(65) Prior Publication Data

US 2008/0191995 A1 Aug. 14, 2008

Related U.S. Application Data

(63) Continuation of application No. 10/840,106, filed on May 6, 2004, now Pat. No. 7,375,723.

(30) Foreign Application Priority Data

Jun. 10, 2003 (KR) ..... 10-2003-0037232
Oct. 13, 2003 (KR) ..... 10-2003-0071030

(51) Int. Cl.
*G09G 3/36* (2006.01)

(52) U.S. Cl. ..... 345/101; 345/204; 345/87; 345/89

(58) Field of Classification Search ..... 345/101, 345/204, 87, 89
See application file for complete search history.

(56) References Cited

U.S. PATENT DOCUMENTS 6,075,513 A 6/2000 Reddy et al.
6,604,236 B1 * 8/2003 Draper et al. ..... 717/170
6,833,886 B2 * 12/2004 Suzuki et al. ..... 349/87
7,106,287 B2 9/2006 Ham
2002/0044151 A1 4/2002 Ijima et al.
2002/0140652 A1 10/2002 Suzuki et al.
2003/0001810 A1 1/2003 Yamaguchi et al.
2003/0098839 A1 5/2003 Lee

FOREIGN PATENT DOCUMENTS

JP 2002-297104 A 10/2002

OTHER PUBLICATIONS

European Examination Report for Application No. 04 012 195.6-2205 dated Dec. 7, 2009.
Baek-Woon Lee, et al; "51.2 Reducing Gray-Level Response to One Frame: Dynamic Capacitance Compensation" SID 01 Digest, vol. XXXII, 2001, pp. 1260-1263.

(Continued)

*Primary Examiner* — William Boddie
*Assistant Examiner* — Leonid Shapiro
(74) *Attorney, Agent, or Firm* — Cantor Colburn LLP

(57) ABSTRACT

An image display device includes an image signal source unit to provide primary image data and selected compensation data to compensate the primary image data, and a display unit to display images using compensated image data obtained by compensating the primary image data with the selected compensation data. The selected compensation data is selected from a set of compensation data in response to variation of ambient temperature of the display device. The image display device also includes a temperature sensor to detect the variation of the ambient temperature of the display device and provide temperature data corresponding to the variation of the ambient temperature. The image display device also includes a frequency sensor to detect frequency variation in a vertical synchronizing signal of the display unit, wherein the selected compensation data is selected from a set of compensation data in response to the variation of the ambient temperature and the frequency variation.

14 Claims, 10 Drawing Sheets

OTHER PUBLICATIONS
European Search Report Application No. EP 04 01 2195; Date: Mar. 30, 2006.
European Examination Report for application No. 04012195.6-2205 dated Mar. 18, 2008.
Examination Report for Application No. 04 012 195.6-2205 dated Jun. 19, 2012.

* cited by examiner

DISPLAY DEVICE COMPENSATING PRIMARY IMAGE DATA TO INCREASE A RESPONSE SPEED OF THE DISPLAY

This application is a continuation application of U.S. application Ser. No. 10/840,106 filed on May 6, 2004, which claims priority to Korean Patent Application No. 2003-0037232 filed on Jun. 10, 2003 and Korean Patent Application No. 2003-71030 filed Oct. 13, 2003, and all the benefits accruing therefrom under 35 U.S.C. §119, the contents of which in their entirety are herein incorporated by reference.

BACKGROUND OF THE INVENTION

1. Field of the Invention

The present invention relates to image display devices and method, and more particularly, to a display device and method to optimize a response time of the display device by compensating image data using look-up tables of compensation data in association with temperature variation and frequency variation of the display device.

2. Description of the Related Art

Liquid crystal display (LCD) devices generally have merits such as high and uniform luminance, high efficiency, long lifetime, thin thickness, light weight, low cost and so on. The LCD devices with such merits have widely used for various types of electronic goods such as desk-top computers, notebook computers, automotive navigation systems, television sets, etc.

In particular, when an LCD device is employed in a television set, a response time of the LCD device is an important factor in displaying, especially, moving images.

In other words, compared to other electronic goods, such as computers, mostly displaying standing images, televisions usually display more moving images. Since the display quality of moving images is affected by the response time of an LCD device employed in a television set, there have been developments to improve the response time of LCD devices.

The response time of conventional LCD devices for changing a gray to another gray is in the range from about 10 ms to about 16 ms. Since the vertical frequency of a television receiver set according to national television system committee (NTSC) is 60 Hz, a time period of one (1) frame is about 16.7 ms. Thus, it has been desired to improve the response time of LCD devices to meet such a standard.

The response time of an LCD device is dependent on ambient temperature of the LCD device. A dielectric constant of liquid crystal in an LCD device varies depending on the ambient temperature of the LCD device. A dielectric constant of liquid crystal aligned parallel with a substrate and a dielectric constant of liquid crystal aligned perpendicular to the substrate vary in accordance with variation of the ambient temperature. The difference between the dielectric constant of the liquid crystal aligned parallel with the substrate and that of the liquid crystal aligned perpendicular to the substrate also varies in accordance with variation of the ambient temperature. This is because the order parameter of the liquid crystal varies in accordance with variation of the ambient temperature.

In addition to the ambient temperature, the response time of an LCD device also varies in association with a vertical synchronizing signal of the LCD device. In case that the frequency of a vertical synchronizing signal of an LCD device is changed, the response time of the LCD device is also affected by the variation of the frequency of the vertical synchronizing signal.

Therefore, a need exists for a display system which provides quality images by improving the response time of a display device. Further, it will be advantageous to provide a method of improving the response time of a display device in association with an ambient temperature of the display device and a frequency of a vertical synchronizing signal of the display device.

BRIEF SUMMARY OF THE INVENTION

The above mentioned and other drawbacks and deficiencies of the prior art are overcome or alleviated by the enhanced performance telecommunications connector of the present invention. In one embodiment, an image display device includes an image signal source unit to provide primary image data and selected compensation data to compensate the primary image data, and a display unit to display images using compensated image data obtained by compensating the primary image data with the selected compensation data, in which the selected compensation data is selected from a set of compensation data in response to variation of ambient temperature of the display device. The image display device may also include a temperature sensor to detect the variation of the ambient temperature of the display device and provide temperature data corresponding to the variation of the ambient temperature.

The image signal source unit includes, for example, a data processing part to provide the primary image data to the display unit, a first memory to store the set of compensation data in which each compensation data is associated with corresponding one of different temperature ranges, and a first controller to read the selected compensation data from the first memory in response to the temperature data from the temperature sensor and provide the selected compensation data to the display unit. The set of compensation data is look-up tables of compensation data each of which is associated with corresponding one of the temperature ranges. The display unit includes, for example, a second controller to receive the primary image data from the data processing part and the selected compensation data from the first controller and generate the compensated image data, a data driver to receive the compensated image data and generate compensated driving voltage signals, and a display panel to receive the compensated driving voltage signals to display the images. The image display device may also include a second memory to store the selected compensation data so that the second controller reads the selected compensation data from the second memory to compensate the primary image data. The second memory may store the selected compensation data such that the look-up tables of compensation data are each stored at corresponding address in the second memory and checksum data is assigned to each of the look-up tables.

The second controller includes, for example, a serial-parallel converting part to convert the selected compensation data into parallel compensation data, a third memory to store compensation data associated with characteristics of the display unit, a first switching part to transfer one of the parallel compensation data from the serial-parallel converting part and the compensation data from the third memory in response to a first clock signal which is a clock for transferring the selected compensation data from the second memory to the serial-parallel converting part, and a fourth memory to store output of the first switching part in response to a second clock signal. The second controller may also include a second switching part to transfer one a serial clock signal and a dot clock signal in response to the first clock signal, and a third switching part to transfer one of output of the second switching part and the dot clock signal in response to a clock signal associated with completion of transfer of the selected compensation data to the serial-parallel converting part, in which an output of the third switching part is provided to the fourth memory as the second clock signal.

In another embodiment, the second controller includes a serial-parallel converting part to convert the selected compensation data into parallel compensation data, a buffer to store the parallel compensation data and generate the parallel compensation data in response to a buffer control clock, a third memory to store compensation data associated with characteristics of the display unit, a first switching part to transfer one of the parallel compensation data from the buffer and the compensation data from the third memory in response to a first clock signal which is a clock for transferring the selected compensation data from the second memory to the serial-parallel converting part, and a fourth memory to store output of the first switching part in response to a dot clock signal. The second controller may also include a logic gate to perform logic AND operation with respect to a vertical synchronizing signal of the display unit and a clock signal associated with completion of transfer of the selected compensation data to the serial-parallel converting part, a second switching part to transfer one a serial clock signal and the dot clock signal in response to the first clock signal, and a third switching part to transfer one of output of the second switching part and the dot clock signal in response to an output of the logic gate, in which an output of the third switching part is provided to the buffer as the buffer control signal.

In another embodiment, the image display device includes a frequency sensor to detect frequency variation in a vertical synchronizing signal of the display unit. The selected compensation data is selected from a set of compensation data in response to the variation of the ambient temperature and the frequency variation.

In another embodiment, a method of compensating primary image data to increase a response speed of a display system, includes storing a plurality of look-up tables of compensation data in a memory in which each of the look-up tables is associated with corresponding one of different temperature ranges, detecting variation of ambient temperature of the display system, selecting a look-up table of compensation data in response to the detected variation of the ambient temperature, and compensating the primary image data using the selected look-up table of compensation data. The method may also include storing the selected look-up table of compensation data in a buffer at a current frame, and compensating the primary image data using the selected look-up table of compensation data at a next frame, in which the selected look-up table of compensation data is transferred from the buffer to a memory to be accessed during the compensation.

In another embodiment, the method further includes storing the plurality of look-up tables of compensation data in the memory in which each of the look-up tables is associated with corresponding one of the different temperature ranges and corresponding one of different frequency ranges, detecting frequency variation in a vertical synchronizing signal of the display system, and selecting a look-up table of compensation data in response to the detected variation of the ambient temperature and the detected frequency variation of the vertical synchronizing signal.

These and other objects, features and advantages of the present invention will become apparent from the following detailed description of illustrative embodiments thereof, which is to be read in connection with the accompanying drawings.

BRIEF DESCRIPTION OF THE DRAWINGS

The above and other advantages of the present invention will become more apparent by describing in detail exemplary embodiments thereof with reference to the accompanying drawings, in which.

DETAILED DESCRIPTION OF THE INVENTION

Detailed illustrative embodiments of the present invention are disclosed herein. However, specific structural and functional details disclosed herein are merely representative for purposes of describing exemplary embodiments of the present invention.

Figure 1:
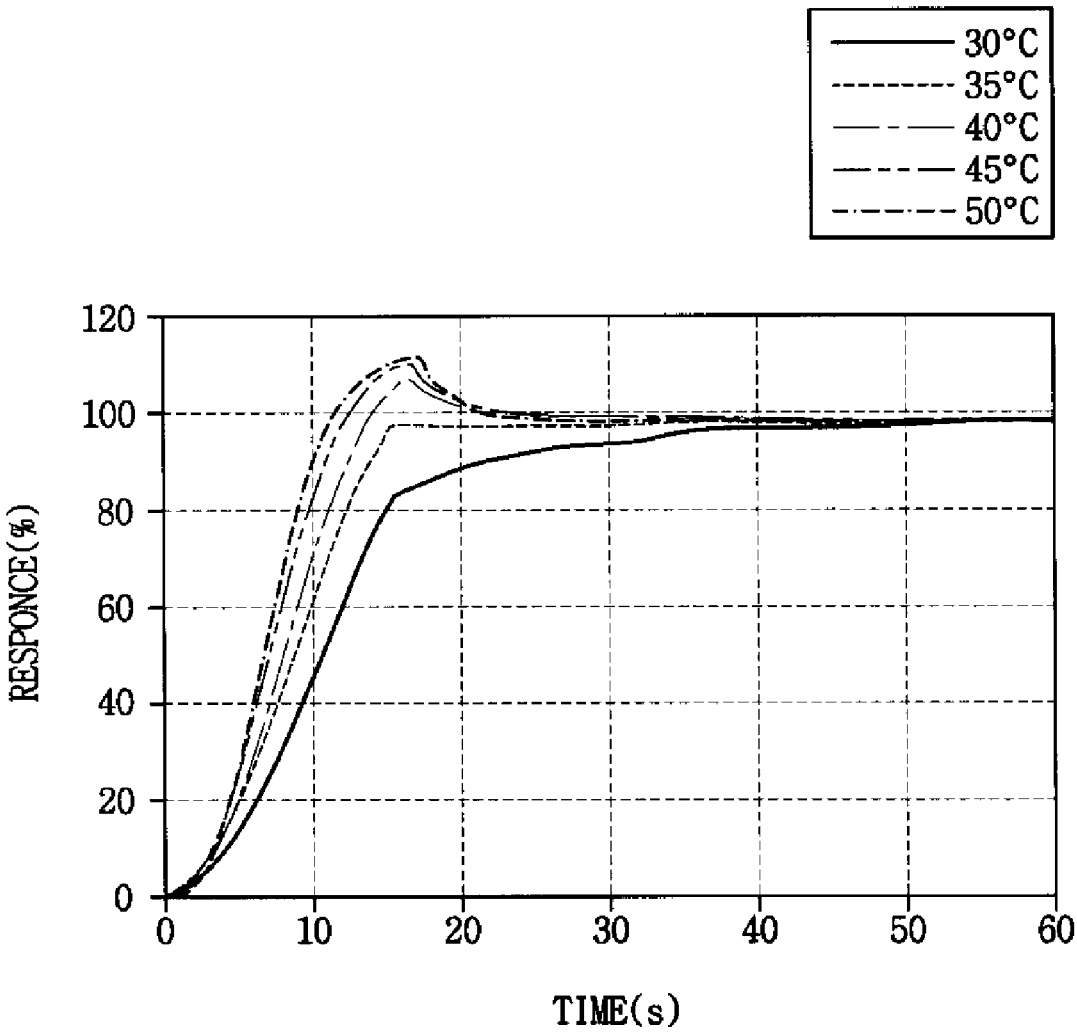
FIG. 1 is a graph comparing a response time of liquid crystal in association with various ambient temperatures of a display device.

FIG. 1 is a graph comparing a response time of liquid crystal in association with various ambient temperatures of a display device in middle gray. Referring to FIG. 1, the liquid crystal is activated in association with the ambient temperature such that the liquid crystal is more readily activated as the ambient temperature increases. Thus, the response time of the liquid crystal increases in proportion to the increase in the ambient temperature.

Since display devices, such as LCD devices, displaying moving images operate in various temperatures (e.g., room temperature, below-zero temperature, etc.), capability of maintaining an optimized response time of a display device in the various temperatures is an important factor for displaying quality images. In case that a display device is operated in a below-zero temperature, the response time of the display device decreases so that the display quality of moving images is deteriorated.

Figure 2:
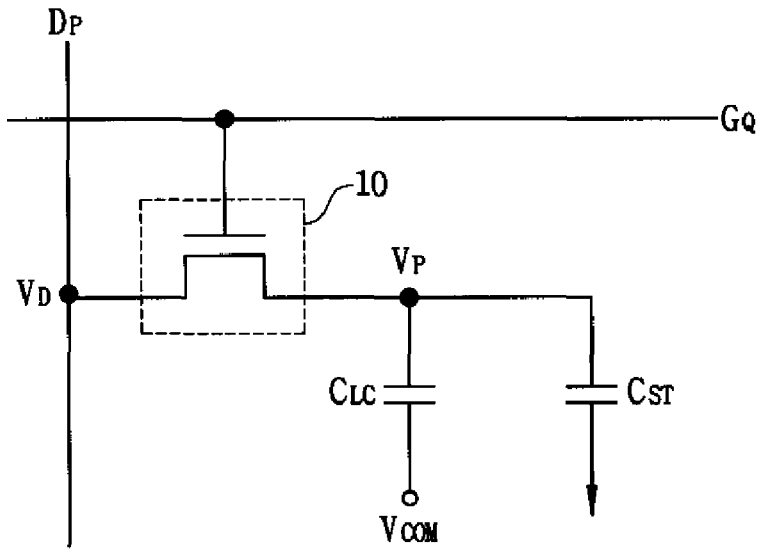
FIG. 2 is a schematic diagram illustrating an equivalent circuit of a pixel of an LCD device.

FIG. 2 is a schematic diagram illustrating an equivalent circuit of a pixel of an LCD device. An LCD device includes pixels each of which is defined by corresponding gate and data lines. A scan signal is provided to the gate lines, and a data signal is provided to the data lines. Each pixel includes a switching element electrically connected to the gate and data lines. The pixels are arranged in a matrix form in the LCD device.

Referring to FIG. 2, the pixel of an LCD device includes a thin film transistor (TFT) 10, a liquid crystal capacitor $C_{LC}$ and a storage capacitor $C_{ST}$. A source electrode of the TFT 10 is electrically connected to a data line $D_p$, and a gate electrode of the TFT 10 is electrically connected to a gate line $G_Q$. The liquid crystal capacitor $C_{LC}$ has capacitance formed by liquid crystal disposed at corresponding one of the pixels in the LCD device. In other words, the liquid crystal capacitor $C_{LC}$ is equivalent to the liquid crystal disposed between a drain electrode of the TFT 10 and a common electrode in the LCD device. The storage capacitor $C_{ST}$ is electrically connected to the drain electrode of the TFT 10.

When a gate-on signal is applied to the gate line $G_Q$ and the TFT 10 is turned-on, a data voltage $V_D$ is applied from the data line $D_p$ to a pixel electrode (not shown) through the TFT 10. An electric field is formed by a voltage difference between a pixel voltage Vp applied to the pixel electrode and a common voltage Vcom to vary light transmittance of the liquid crystal disposed between the pixel electrode and the common electrode. The storage capacitor $C_{ST}$ maintains the voltage difference during a time period of one frame.

The liquid crystal is dielectric anisotropic material so that a dielectric constant of the liquid crystal varies with respect to a direction of molecules of the liquid crystal. Therefore, when a voltage is applied between the pixel electrode and the common electrode, a capacitance of the liquid crystal capacitor $C_{LC}$ varies with respect to a variation of the dielectric constant of the liquid crystal. Charge is applied to the liquid crystal capacitor $C_{LC}$ while the TFT 10 is turned on, and the pixel voltage (Vp) applied to the liquid crystal varies in accordance to the capacitance of the liquid crystal ($C_{LC}$). Here, the relationship of charge Q, capacitance C, and voltage V is represented by the following Equation 1.

$$Q=CV \qquad \text{Equation 1}$$

In twisted nematics (TN) liquid crystal which is normally white mode, molecules of the liquid crystal are arranged parallel with a substrate of the LCD device when the pixel voltage is about 0V.

The capacitance of the liquid crystal $C_{LC}$ is represented by Equation 2.

$$C_{LC}(0V)=\epsilon_{\perp}A/d \qquad \text{Equation 2}$$

Here, '$\epsilon_{\perp}$' denotes a dielectric constant of the liquid crystal of which molecules are arranged perpendicular to a direction of the light that is applied to the liquid crystal, 'A' denotes an areal size of the LCD substrate, and 'd' denotes a distance between substrates of the LCD device.

When the pixel voltage is about 5V, the liquid crystal molecules are arranged parallel with the substrate so that the display mode becomes full-black. In this case, the capacitance of the liquid crystal $C_{LC}$ is represented by Equation 3.

$$C_{LC}(5V)=\epsilon_{\theta}A/d \qquad \text{Equation 3}$$

Here, '$\epsilon_{\theta}$' denotes a dielectric constant of the liquid crystal of which molecules are arranged parallel with a direction of the light applied to the liquid crystal. Since dielectric constant '$\epsilon_{\theta}$' is larger than dielectric constant '$\epsilon_{\perp}$', the capacitance of the twisted nematic liquid crystal increases in proportion to the pixel voltage applied to the liquid crystal.

A charge of the TFT for displaying full-black in an [n]th frame needs to be about $C_{LC}(5V)\times 5V$. Assuming that the full-white was displayed in the [n−1]th frame, the capacitance of the liquid crystal is about $C_{LC}(0V)$ in the [n]th frame because the liquid crystal molecules do not effectively change the arrangement while the TFT is turned on. In other words, the voltage applied to the pixel electrode for displaying the full-white is about 0V in the [n−1]th frame. Although the data voltage is about 5V in the [n]th frame to display the full-black, the charge of the pixel electrode is about $C_{LC}(0V)\times 5V$. Since capacitance $C_{LC}(0V)$ is less than capacitance $C_{LC}(5V)$, the pixel voltage Vp in the [n]th frame is less than 5V (e.g., about 3.5V). As a result, the full-black is not effectively displayed.

Also, when the data voltage $V_D$ of about 5V is applied in the [n+1]th frame to display the full-black, the charge of the liquid crystal is about $C_{LC}(3.5V)\times 5V$ so that the pixel voltage Vp is increased. In other words, the pixel voltage Vp becomes in the range from about 3.5V to about 5V in the [n+1]th frame. In like manner, the data voltage $V_D$ of 5V is applied and the pixel voltage Vp increases in the subsequent frames until the pixel voltage Vp becomes or approximates 5V.

When the gray-scale of a pixel is changed, the gray-scale of the present frame is dependent on the gray-scale of the previous frame so that a pixel has a desired gray-scale after several frames. In like manner, when the transmittance of the liquid crystal is changed, the transmittance of the present frame is dependent on the transmittance of the previous frame so that the liquid crystal has a desired transmittance after several frames.

Assuming that the full-black is displayed in the [n−1]th frame and the pixel voltage Vp of 5V is applied to the pixel in the [n]th frame, the charge of the pixel is about $C_{LC}(5V)\times 5V$ so that the pixel voltage Vp of the liquid crystal is about 5V. Accordingly, the full-black is effectively displayed in the [n]th frame. Therefore, the pixel voltage Vp of the present frame is dependent on the pixel voltage Vp of the previous frame as well as the data voltage of the present frame.

Figure 3:
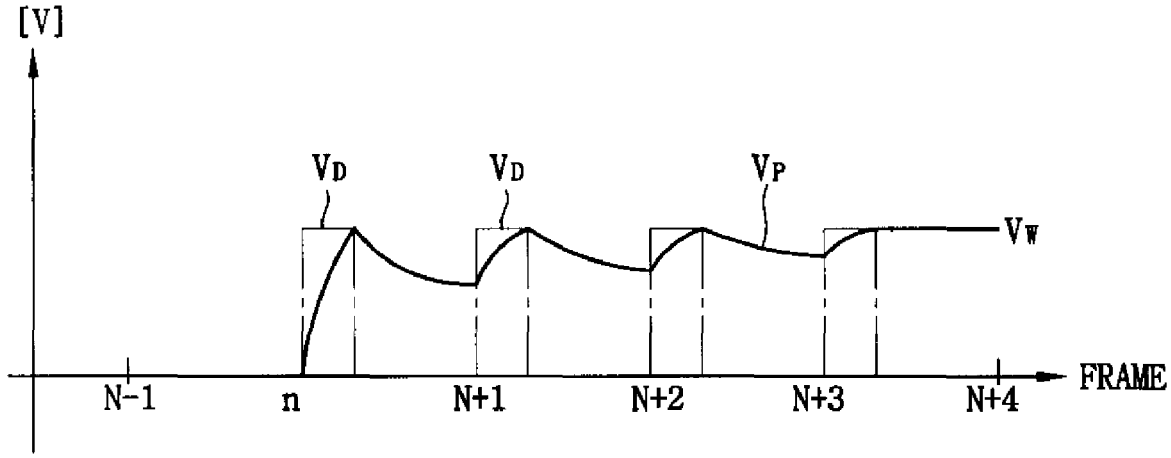
FIG. 3 is a graph illustrating data and pixel voltages in an LCD device.
Figure 4:
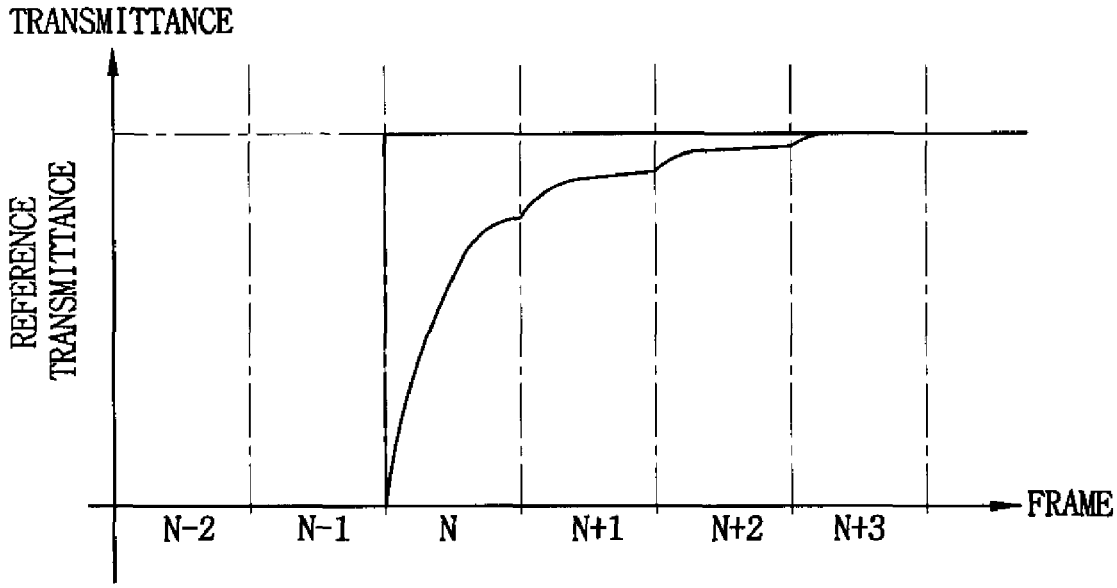
FIG. 4 is a graph illustrating transmittance of an LCD device.

FIG. 3 is a graph illustrating data and pixel voltages in an LCD device, and FIG. 4 is a graph illustrating transmittance of an LCD device. FIGS. 3 and 4 show the results of the experiments in which the LCD device is operated without consideration of the effect of previous frames.

Referring to FIG. 3, a data voltage $V_D$ substantially equal to a desired pixel voltage Vw is applied to the pixel in frames N to N+3. As shown in FIG. 3, the pixel voltage (Vp) of the liquid crystal is less than the desired pixel voltage Vw in frames N to N+2, and it becomes approximate to the desired pixel voltage Vw in the [N+3]th frame. Referring to FIG. 4, the liquid crystal also has a desired transmittance after several frames.

In contrast, in the present invention, a pixel signal (Pn−1) of the previous frame is compared with a pixel signal (Pn+1) of the next frame to generate a compensation pixel signal (Pn') for the present frame. The compensation pixel signal (Pn') is applied to an pixel electrode of the LCD device in the present frame. In case of an analog type LCD device, the pixel signal (Pn) is a data voltage. On the other hand, in case of a digital type LCD device, the pixel signal (Pn) is gray-scale of binary data to control the data voltage. In this case, the gray-scale data is compensated so as to compensate the data voltage applied to each pixel.

When the pixel signal (i.e., the data voltage or the gray-scale data) of the present frame is substantially equal to that of the previous frame, the pixel signal is not compensated. When the gray-scale data of the present frame is larger than that of the previous frame, compensated gray-scale data larger than the gray-scale signal of the present frame is outputted. When the gray-scale data of the present frame is smaller than that of the previous frame, the compensated gray-scale data smaller than the gray-scale data of the present frame is outputted. The amount of the compensation is in proportion to the difference between the gray-scale data of the frames.

Figure 5:
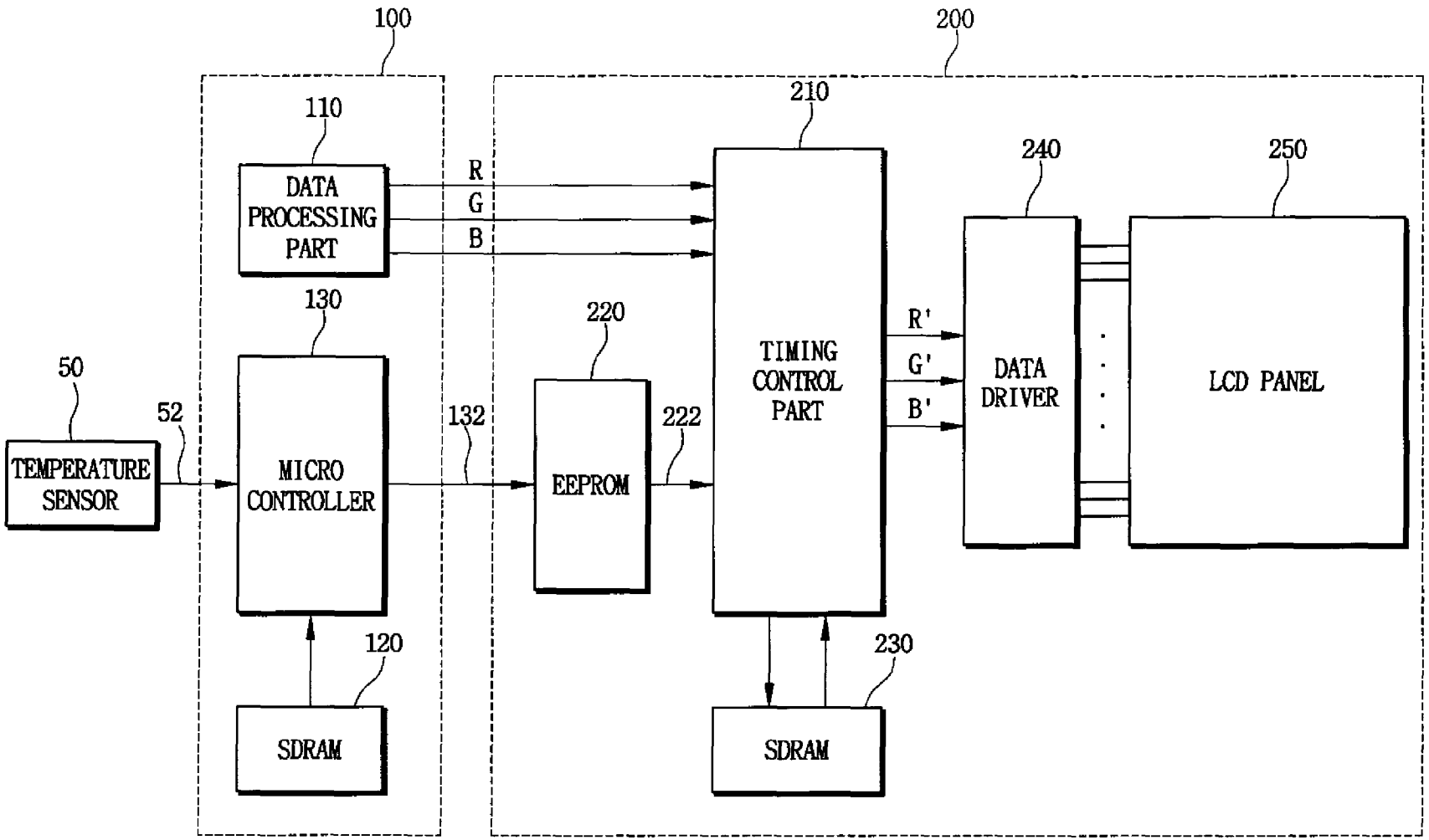
FIG. 5 is a block diagram illustrating a display system according to an exemplary embodiment of the present invention.

FIG. 5 is a block diagram illustrating a display system according to an exemplary embodiment of the present invention. Referring to FIG. 5, the display system includes a image signal source 100 and an LCD device 200. The image signal source 100 outputs primary gray-scale data RGB and compensation data 132, and the LCD device 200 displays images by using the primary gray-scale data and the compensation data.

The image signal source 100 includes a data processing part 110, a synchronous dynamic random access memory (SDRAM) 120, and a micro controller 130. The image signal source 100 outputs the primary gray-scale data RGB to the LCD device 200 for displaying images thereon, and outputs the compensation data 132 in response to temperature data 52 detected by and provided from a temperature sensor 50. The image signal source 100 is, for example, a computer, a signal processing block of a television receiver set, etc, electrically connected to the LCD device 200.

The data processing part 110 outputs the primary gray-scale data provided to the LCD device 200. The primary gray-scale data includes red (R) primary gray-scale data, green (G) primary gray-scale data and blue (B) primary gray-scale data.

The SARM 120 stores look-up tables (LUTs) of compensation data to optimize the response time of the LCD device 200. The LUTs are each associated with corresponding one of different temperature ranges. In other words, each LUT contains compensation data for a selected temperature range. The micro controller 130 selects an LUT of compensation data in response to the temperature data 52 provided from the temperature sensor 50 and outputs the selected LUT of compensation data to the LCD device 200.

The LCD device 200 includes a timing control part 210, a first memory 220, a second memory 230, a data driver 240 and an LCD panel 250. For example, the first memory 220 is implemented with an electrical erasable programmable read only memory (EEPROM), and the second memory 230 is implemented with a synchronous dynamic random access memory (SDRAM). In the LCD device 200, the timing control part 210 provides compensated gray-scale data R'G'B' to the data driver for driving the LCD panel 250. The compensated gray-scale data is obtained from the primary gray-scale data and the compensation data 132 provided from the image signal source 100 to improve (i.e., decrease) the response time of the LCD device 200. The compensated gray-scale data includes red (R') compensated gray-scale data, green (G') compensated gray-scale data and blue (B') compensated gray-scale data. The compensated gray-scale data R'G'B' is associated with the ambient temperature of the display system and updated in accordance with variation of the ambient temperature.

When the primary gray-scale data is provided from the data processing part 110 to the timing control part 210, the timing control part 210 processes the primary gray-scale data of the previous and present frames to generate the compensated gray-scale data. Thus, the compensation gray-scale data improves the time response of the LCD device owing to the process of the primary gray-scale data of the previous and present frames and the compensation data associated with the different temperature ranges.

The compensation data 132 provided from the micro controller 130 is stored in the first memory 220 (e.g., EEPROM). The compensation data 132 is to compensate the gray-scale data based on the ambient temperature of the display system and is selected from the LUTs of compensation data in accordance with the temperature data 52 generated from the temperature sensor 50. The compensation data stored in the first memory 220 in an LUT form is read out by the timing control part 210.

For example, in case that the primary gray-scale data is 8-bit data, the compensation data may be 8-bit data or 4- or 6-bit data. If the compensation data is 4- or 6-bit data, the 4- or 6-bit data of the primary gray-scale data is compensated by the LUT of compensation data and remaining-bit data is compensated using an interpolation method so as to decrease the response time.

The timing control part 210 controls read/write operation of the primary gray-scale data from/into the second memory 230 (e.g., SDRAM). The timing control part 210 supplies the compensated gray-scale data to the data driver 240, and the data driver 240 transforms the compensated gray-scale data to an analog voltage signal. Then, the analog voltage signal is provided to the LCD panel 250 via data lines of the LCD device 200.

In case that the ambient temperature is below zero in Celsius, the response time of the liquid crystal is improved (i.e., decreased) by compensating the gray-scale data using an LUT of compensation data appropriate for the below-zero temperature range. In contrast, when the ambient temperature is increased, the response time of the liquid crystal is also improved by compensating the gray-scale data using an LUT of compensation data appropriate for the increased temperature range.

The LUT of compensation data stored in the first memory 220 is changed in response to variation of the ambient temperature which is sensed by the temperature sensor 50. The micro controller 130 reads out an appropriate LUT of compensation data from the SDRAM 120 in response to the temperature data 52 provided from the temperature sensor 50, and the appropriate LUT of compensation data is stored in the first memory 220. The timing control part 210 compensates the primary gray-scale data using the appropriate LUT of compensation data to optimize the response time of the display system at the given ambient temperature. Further, for example, power of the LCD device 200 is controlled in response to the variation of the compensation data so as to prevent malfunction of a lamp of the LCD device. Also, an $I^2C$ bus (not shown) electrically connecting the micro controller 130 to the first memory 220 may be controlled to change the LUT of compensation data in the first memory 220.

When the LUT of compensation data is stored in the first memory 220, the micro controller 130 directly controls the timing control part 210 so that the compensation data is downloaded from the first memory 220 into a read only memory (ROM) in the timing control part 210. In case that a time period of changing the LUT of compensation data is long, a predetermined alarm message stored in the memory 120 of the image signal source 100 is displayed on the LCD panel 250.

Figure 6:
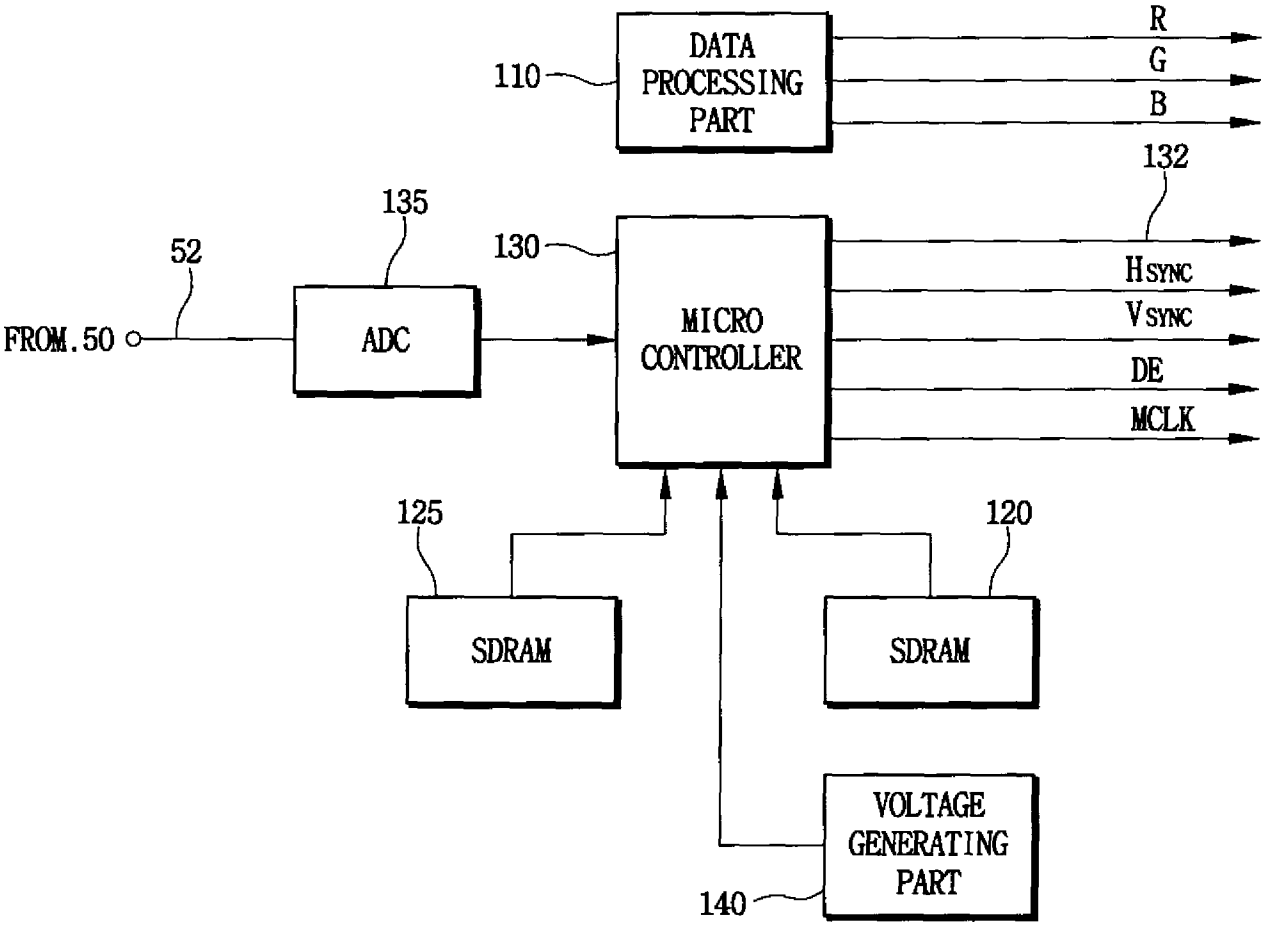
FIG. 6 is a block diagram illustrating the image signal source in FIG. 5 according to an exemplary embodiment of the present invention.

FIG. 6 is a block diagram illustrating the image signal source in FIG. 5 according to an exemplary embodiment of the present invention. Referring to FIG. 6, the image signal source 100 includes the data processing part 110, a first memory 120, a second memory 125, the micro controller 130, an analog-digital converter 135, and a voltage generating part 140. The first and second memories 120 and 125 are, for example, synchronous dynamic random access memories (SDRAMs).

The data processing part 110 outputs primary gray-scale data RGB to display images. The primary gray-scale data includes red primary gray-scale data R, green primary gray-scale data G, and blue primary gray-scale data B.

The compensation data for improving the response time of liquid crystal is stored in the first memory 120 in the form of look-up tables. The LUTs of compensation data stored in the first memory 120 are each associated with corresponding one of different temperature ranges. For example, the first LUT of compensation data contains the compensation data for a temperature range from −10° C. to 0° C., the second LUT of compensation data contains the compensation data for a temperature range from 0° C. to 10° C., the third LUT of compensation data contains the compensation data for a temperature range from 10° C. to 20° C., and the fourth LUT of compensation data contains the compensation data for a temperature range from 20° C. to 30° C.

The second memory 125 stores on-screen display (OSD) data for classified characteristic values of the display system. The classified characteristic values may be changed by a user using switches on the display system or its remote controller. The image signal source 100, such as a television receiver set, includes an OSD unit having the OSD data. The image signal source includes an OSD unit for controlling the response speed of the liquid crystal of the LCD device. For example, the OSD unit includes a temperature response mode and a reference value mode.

The micro controller 130 provides the compensation data 132, horizontal and vertical synchronizing signals Hsync and Vsync, a data enable signal DE, and a main clock MCLK to the LCD device 200 to display the primary gray-scale data outputted from the data processing part 110. The micro controller 130 supplies the compensation data 132 in an LUT form corresponding to a selected temperature range in response to the temperature data provided through the analog-digital converter 135. The analog-digital converter 135 converts a analog signal of the temperature data into digital data.

When the temperature data is applied to the micro controller 130, the LUT of compensation data corresponding to the temperature data is selected from the first memory 120 and provided to the LCD device 200. The LUT of compensation data is transferred, for example, through an inter-IC ($I^2C$) bus that is a parallel bus including two data lines.

The voltage generating part 140 generates a voltage for the micro controller 130. For example, the voltage generating part 140 is independent of a power source of the display system so as to prevent malfunction of the micro controller 130.

Figure 7:
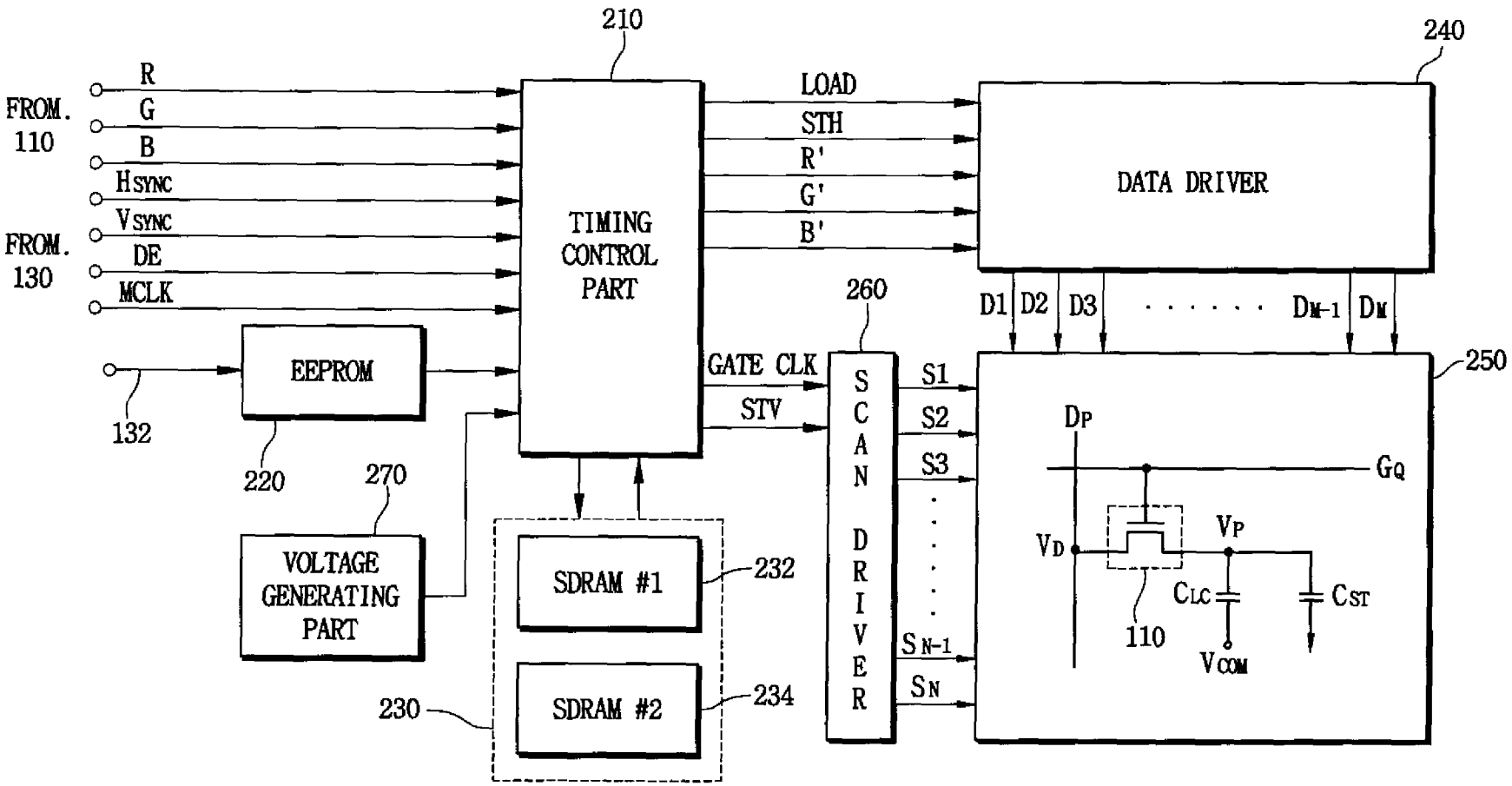
FIG. 7 is a block diagram illustrating the LCD device in FIG. 5 according to an exemplary embodiment of the present invention.

FIG. 7 is a block diagram illustrating the LCD device in FIG. 5 according to an exemplary embodiment of the present invention. Referring to FIG. 7, the LCD device includes the timing control part 210, the first memory 220, the second memory 230, the data driver 240, the LCD panel 250, a scan driver 260, and a voltage generating part 270. The first memory 220 is, for example, an electrical erasable programmable read only memory (EEPROM), and the second memory 230 is, for example, a synchronous dynamic random access memory (SDRAM).

The micro controller 130 of the image signal source 100 provides the primary gray-scale data, the synchronizing signals (Hsunc, Vsync), the data enable signal (DE) and the main clock (MCLK) to the timing control part 210. The primary gray-scale data includes red (R) primary gray-scale data, green (G) primary gray-scale data and blue (B) primary gray-scale data. The timing control part 210 provides the compensated gray-scale data and data driving signals (LOAD, STH) for outputting the compensated gray-scale data to the data driver 240, and also provides scan driving signals (GATE CLK and STV) to the scan driver 260. The compensated gray-scale data includes red (R') compensated gray-scale data, green (G') compensated gray-scale data and blue (B') compensated gray-scale data.

The micro controller 130 provides a selected LUT of compensation data 132 to the timing control part 210. The selected LUT of compensation data is stored in the first memory 220 and then read out by the timing control part 210. In another embodiment, the LUT of compensation data 132 is directly stored in an internal memory (not shown) of the timing control part 210.

The data processing part 110 of the image signal source 100 provides the primary gray-scale data to the timing control part 210. The gray-scale data of the present frame is compared with the gray-scale data of the previous frame to determine the compensated gray-scale data of the present frame. The compensated gray-scale data is provided to the data driver 240 so that the response speed of liquid crystal is increased.

The first memory 220 stores the LUTs of compensation data 132. Each of the LUTs of compensation data 132 contains compensation information (or compensation amount) in a selected temperature range. When the ambient temperature is changed, the micro controller 130 selects and supplies an LUT of compensation data corresponding to the changed ambient temperature to the first memory 220, and then the selected LUT of compensation data is provided to the timing control part 210 from the first memory 220.

The primary gray-scale data is stored in the second memory 230. The second memory 230 includes a first memory bank 232 and a second memory bank 234. When a half of the primary gray-scale data of the present frame is written in the first memory bank 232 by the timing control part 210, the timing control part 210 reads a half of the primary gray-scale data of the previous frame from the second memory bank 234. Also, when the timing control part 210 reads the half of the primary gray-scale data of the previous frame from the second memory bank 234, the half of the primary gray-scale data of the present frame may be written in the first memory bank 232 by the timing control part 210. With the first and second memory banks 232 and 234 of the second memory 230, the reading and writing operations are performed simultaneously and continuously.

The data driver 240 receives the compensated gray-scale data R'G'B' from the timing control part 210 and provides the data signals D1-$D_M$ to data lines, respectively, of the LCD panel 250. The timing control part 210 supplies the scan driving signals (GATE CLK, STV) to the scan driver 260 which then provides gate-on signals S1-$S_N$ for turning on switch elements in the LCD panel 250.

In the LCD panel 250, the gate lines are scan lines for transmitting the gate-on signals S1-$S_N$ and the data lines are source lines for transmitting the data signals D1-$D_M$. The LCD panel 250 includes multiple pixels each of which is defined by the adjacent gate and data lines. Each pixel includes a thin film transistor (TFT) 110 as the switching element, a liquid crystal capacitor $C_{LC}$ and a storage capacitor $C_{ST}$. Gate and source electrodes of the TFT are electrically connected to the gate and source lines, respectively. The liquid crystal capacitor $C_{LC}$ is electrically connected to a drain electrode of the TFT.

The second voltage generating part 270 controls electric power of the LCD device. When the LUT of compensation data is written in the first memory 220, the second voltage generating part 270 controls the electric power of the LCD device so as to prevent malfunction.

In the embodiment of FIGS. 5-7, the display system employs the digital interface such that the digital gray-scale data is provided from the image signal source to the LCD device. However, it would obvious to one skilled in the art that the LCD device includes an interface unit for processing an analog signal externally provided to the LCD device to transform it into the digital data.

Figure 8:
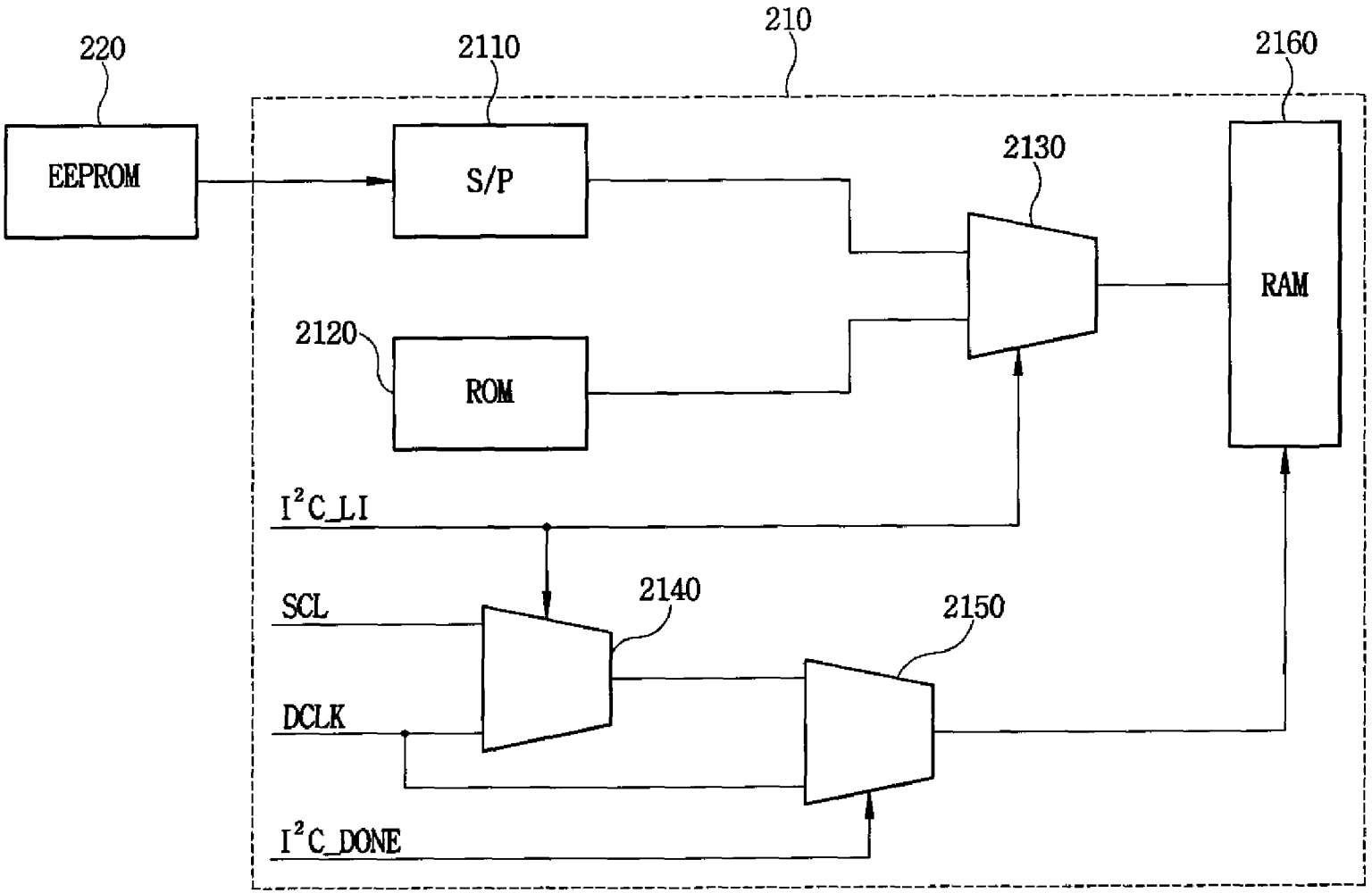
FIG. 8 is a block diagram illustrating the timing control part in FIGS. 5 and 7 according to an exemplary embodiment of the present invention.

FIG. 8 is a block diagram illustrating the timing control part in FIGS. 5 and 7 according to an exemplary embodiment of the present invention. Referring to FIG. 8, the timing control part 210 includes a serial-parallel converting part 2110, a first memory (e.g., read only memory or ROM) 2120, a first switching part 2130, a second switching part 2140, a third switching part 2150, and a second memory (e.g., random access memory or RAM) 2160. The LUTs of compensation data are stored in memory 220, and an LUT of compensation data is selected based on LUT select signals externally provided, for example, from the television receiver set. The selected LUT of compensation data is stored in memory 2160, and the timing control part 210 compensates the gray-scale data in accordance with the selected LUT stored in memory 2160. The first to third switching parts 2130, 2140 and 2150 are each implemented with, for example, a multiplexer.

The LUT of compensation data read from memory 220 is provided to the serial-parallel converting part 2110 which converts the serial type compensation data into parallel type compensation data. Memory 2120 also stores compensation data set by a manufacturer of the display system. The compensation data in memory 2120 is to optimize the response time of the display system in consideration of characteristics of the LCD device. Here, for the purpose of description convenience, the compensation data output from the serial-parallel converting part 2110 is called "first compensation data," and the compensation data output from memory 2120 is called "second compensation data."

The first and second compensation data are provided to the first switching part 2130, and one of them is selected and output from the first switching part 2130 in response to a first control signal which is, for example, a transmission clock $I^2C$_LI. The selected compensation data in the first switching part 2130 is provided to and stored in memory 2160. In this embodiment, the transmission clock $I^2C$_LI is a clock for transmitting the first compensation data output from the serial-parallel converting part 2110. For example, the first switching part 2130 transfers the first compensation data from the serial-parallel converting part 2110 to memory 2160 when the transmission clock $I^2C$_LI is active (e.g., logic high), and the first switching part 2130 transfers the second compensation data from memory 2120 to memory 2160 when the transmission clock $I^2C$_LI is inactive (e.g., logic low). The transmission clock $I^2C$_LI is also a clock for transferring the selected LUT of compensation data to the serial-parallel converting part 2110.

The second switching part 2140 receives a serial clock SCL and a dot clock DCLK and outputs one of them in response to the transmission clock $I^2C$_LI. The serial clock SCL is associated with the transmission clock $I^2C$_LI, the dot clock is associated with the primary gray-scale data provided from the image signal source. The selected one of the serial clock SCL and the dot clock DCLK is then provided to the third switching part 2150. For example, the second switching part 2140 transfers the serial clock SCL to the third switching part 2150 when the transmission clock $I^2C$_LI is active (e.g., logic high), and the second switching part 2140 supplies the dot clock DCLK to the third switching part 2150 when the transmission clock $I^2C$_LI is inactive (e.g., logic low).

The third switching part 2150 receives the output of the second switching part 2140 and the dot clock DCLK and outputs one of the input signals in response to a transmission termination clock $I^2C$_DONE, which is a clock associated with completion of the transfer of the selected compensation data from memory 220 to the serial-parallel converting part 2110. For example, the third switching part 2150 transfers the dot clock DCLK when the transmission termination clock $I^2C$_DONE is active (e.g., logic high), and the third switching part 2150 transfers the output of the second switching part 2140 when the transmission termination clock $I^2C$_DONE is inactive (e.g., logic low). The output of the third switching part 2150 is then provided to memory 2160 as a third control signal. The third control signal is a clock signal, either the dot clock signal DCLK or the output clock signal from the second switching part 2150, to be used in writing operation of the compensation data output from the first switching part 2130. In other words, the compensation data output from the first switching part 2130 is stored in memory 2160 in response to the third control signal, i.e., a clock signal output from the third switching part 2150.

As described above, the time response (or response speed) of the LCD device is affected by variation of ambient temperature. Thus, the time response is improved by compensating the gray-scale data using the LUTs of compensation data each associated with corresponding one of different temperature ranges.

In addition to the variation of the ambient temperature, the time response of the LCD device is affected by a frequency of the vertical synchronizing signal used for the display system. While the compensation amount becomes smaller in the compensation for the ambient temperature variation as the ambient temperature becomes higher, the compensation amount becomes larger in the compensation for the frequency variation of the vertical synchronizing signal as the frequency becomes higher. This is because when the frequency of the vertical synchronizing signal is increased, a time period of a frame is decreased so that the compensation amount needs to be increased.

The first compensation data (i.e., the selected LUT of compensation data) is stored in memory 2160 in response to the serial clock SCL that is slower than the dot clock DCLK. Accordingly, the first compensation data is stored in memory 2160 for a time period of several frames including frame blanking periods. The electric power is continuously supplied to the LCD device while the first compensation data is stored in memory 2160. In this case, when moving images are displayed, malfunction such as a noise, an LUT having inverted color, deformation of a gray-scale, etc., may be displayed on the LCD device due to superposed data and a delay of loading time. For example, real-time inputted gray-scale data is superposed with overshooted data corresponding to the LUT to form the superposed data. The display malfunction may occur because the data corresponding to one frame includes an LUT of compensation data corresponding to a temperature range before a temperature variation and an LUT of compensation data corresponding to a temperature range after the temperature variation.

Figure 9:
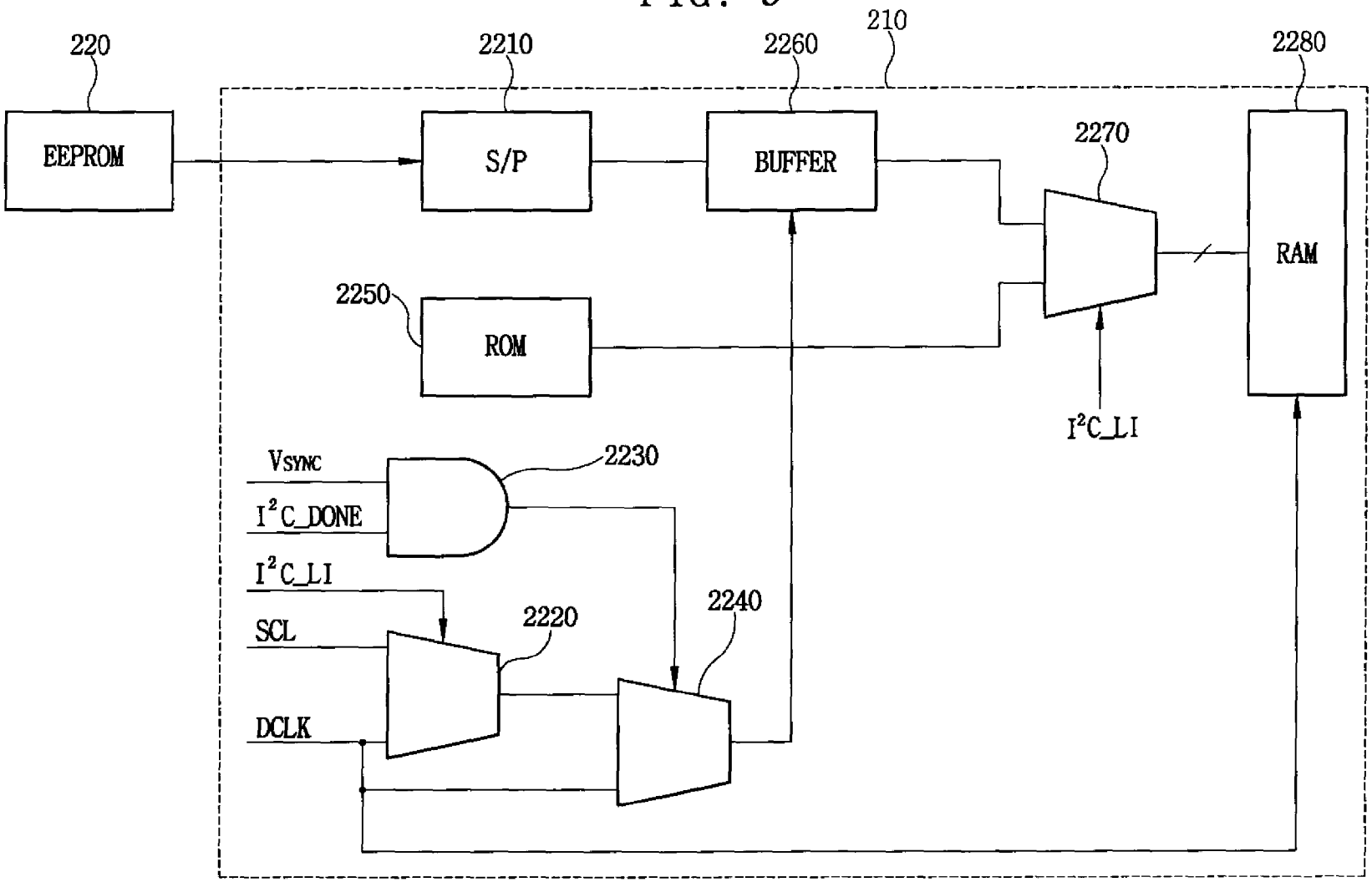
FIG. 9 is a block diagram illustrating the timing control part in FIGS. 5 and 7 according to another exemplary embodiment of the present invention.

FIG. 9 is a block diagram illustrating the timing control part in FIGS. 5 and 7 according to another exemplary embodiment of the present invention. Referring to FIG. 9, the timing control part 210 includes a serial-parallel converting part 2210, a first switching part 2220, an AND gate 2230, a second switching part 2240, a first memory (e.g., ROM) 2250, a buffer 2260, a third switching part 2270, and a second memory (e.g., RAM) 2280. Multiple LUTs of compensation data is stored in memory 220 (e.g., EEPROM). The timing control part 210 determines an LUT in response to a LUT selection signal provided from a television receiver set, and the selected LUT is stored in memory 2280 to be used for the compensation. The first to third switching parts 2220, 2240 and 2270 are each implemented with, for example, a multiplexer.

The selected LUT of compensated data is read from memory 220 and provided to the serial-parallel converting part 2210 in which the serial data is converted into the parallel data. Memory 2250 also stores compensation data set by a manufacturer of the display system. The compensation data in memory 2250 is to optimize the response time of the display system in consideration of characteristics of the LCD device. Here, for the purpose of description convenience, the compensation data output from the serial-parallel converting part 2110 is called "first compensation data," and the compensation data output from memory 2250 is called "second compensation data."

The first switching part 2220 receives the serial clock SCL and the dot clock DCLK and outputs one of them in response to the transmission clock $I^2C$_LI. For example, the first switching part 2220 outputs the serial clock SCL to the second switching part 2240 when the transmission clock $I_2C$_LI is active, and the first switching part 2220 outputs the dot clock DCLK to the second switching part 2240 when the transmission clock $I^2C$_LI is inactive.

The AND gate 2230 receives a vertical synchronizing signal $V_{SYNC}$ and the transmission termination clock $I^2C$_DONE and performs AND operation with respect to the input signals. An output of the AND gate 2230 is provided to the second switching part 2240.

The second switching part 2240 receives the clock outputted from the first switching part 2220 and the dot clock DCLK and outputs one of them in response to the output signal of the AND gate 2230. For example, the second switching part 2240 outputs the clock outputted from the first switching part 2220 when the output of the AND gate 2230 is active, and the second switching part 2240 outputs the dot clock DCLK when the output of the AND gate 2230 is inactive. The output of the second switching part 2240 is provided to the buffer 2260.

The buffer 2260 stores the first compensation data from the serial-parallel converting part 2210 and outputs the first compensation data to the third switching part 2270 in response to the clock outputted from the second switching part 2240. In this embodiment, the buffer 2260 outputs the first compensation data to the third switching part 2270 when the dot clock DCLK is supplied to the buffer 2260 from the second switching part 2240, and the first compensation data is not outputted when the serial clock SCL is applied to the buffer 2260 from the second switching part 2240.

The third switching part 2270 outputs one of the first compensation data outputted from the buffer 2260 and the second compensation data outputted from memory 2250 in response to the transmission clock $I^2C$_LI. The output of the third switching part 2270 is provided to memory 2280. When the transmission clock $I^2C$_LI is active, the third switching part 2270 outputs the first compensation data outputted from the buffer 2260 to memory 2280. When the transmission clock $I^2C$_LI is inactive, the third switching part 2270 outputs the compensation data outputted from memory 2250 to memory 2280. The compensation data output from the third switching part 2270 is stored in memory 2280 in response to the dot clock DCLK.

Figure 10:
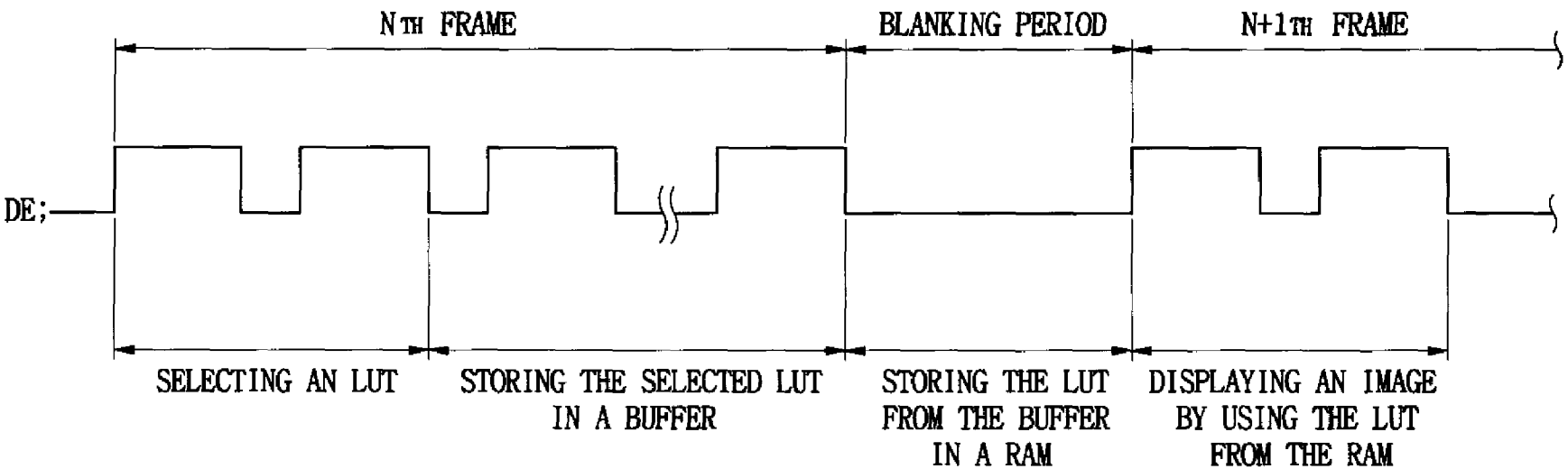
FIG. 10 is a timing diagram for describing the operation of the timing control part in FIG. 9.

FIG. 10 is a timing diagram for describing the operation of the timing control part in FIG. 9, in which the LUT of compensation data is changed during a frame blanking period. Referring to FIGS. 9 and 10, memory 220 stores the LUTs of compensation data each at a corresponding address. When an image is displayed in the [n]th frame, the timing control part 210 receives a selection signal to select an LUT of compensation data for overshooting in response to change of environment (e.g., ambient temperature variation) from a television receiver set through an $I^2C$ bus. The timing control part 210 supplies an address of memory 220 to read the LUT corresponding to the address from memory 220 through the $I^2C$ bus. The LUT corresponding to the memory address is then stored in the buffer 2260. Assuming that the number of the compensation data of the selected LUT is '256', a time period for transmitting the compensation data is between about 10 ms and about 100 ms so that the LUT may be changed without power-off of the LCD device.

The LUT stored in the buffer 2260 is written in memory 2280 during a blanking period, and then a data enable signal DE corresponding to the [n+1]th frame is applied so that an image is displayed using the LUT stored in memory 2280. The frame is changed during the blanking period. The compensation data of the LUT stored in the buffer corresponding to the ambient temperature is written in memory 2280 during the vertical synchronizing signal is applied to the timing control part. Thus, the compensation data for improving the response speed of the liquid crystal is changed without turning off the electric power of the LCD device.

When the primary gray-scale signal includes 16 gray-scale, the primary gray-scale signal includes 256 gray-scale data so that the size of an LUT for overshooting is minimized. That is, the time period required for the 256 gray-scale data may be short so that the compensation data stored in the buffer is stored in memory 2280 during the blanking period. In addition, a time period required for selecting the LUT and applying the selected LUT is no more than about 16.7 ms. Therefore, a user may not sense the variation of the image in response to the variation of the LUT.

Figure 11:
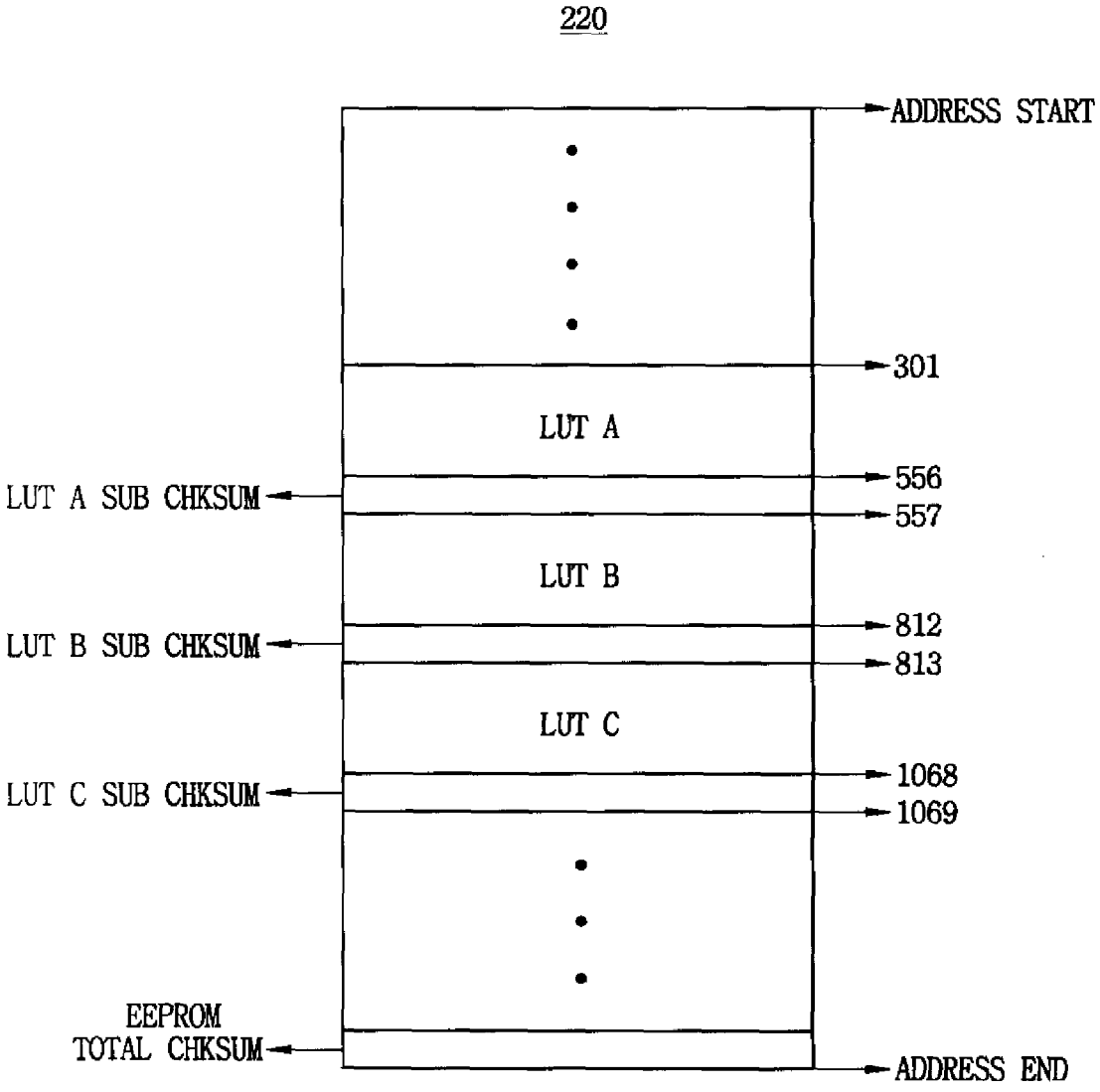
FIG. 11 is a schematic diagram illustrating the LUTs of compensation data stored in a memory of the LCD device in FIGS. 5 and 7 and checksum data of the LUTs.

FIG. 11 is a schematic diagram illustrating the LUTs of compensation data stored in memory 220 of the LCD device in FIGS. 5 and 7 and checksum data of the LUTs. Referring to FIG. 11, the LUTs are stored in memory 220 (e.g., EEPROM) such that each LUT has its own address to be stored therein. In other words, each LUT is stored at a corresponding address in the memory. Thus, when the timing control part reads a selected LUT from the memory in response to variation in the ambient temperature and the vertical synchronizing signal, the timing control part 210 only reads the selected LUT by accessing the corresponding address instead of reading the whole LUTs stored in the memory.

To prevent an error in reading a selected LUT from the memory, the memory includes, for example, checksum data assigned for the LUTs. The checksum data includes multiple sub-checksum data each assigned to corresponding one of the LUTs. Thus, each LUT is stored in the memory in association with corresponding sub-checksum data.

For example, assuming that one LUT has the 256-bit size, if LUT 'A' is stored at address 301 to 556, sub-checksum data of the LUT 'A' is stored at address 556 to 557. In like manner, if LUT 'B' is stored at address 557 to 812, sub-checksum data of LUT 'B' is stored at addresses 812 to 813.

By using the checksum data, gray-scale data corresponding to a selected LUT is stored in memory 2280 (referring to FIG. 9) without an error on the gray-scale data. This is because the timing control part repeatedly reads the selected LUT until no error is detected from the gray-scale data corresponding to the selected LUT.

The multiple sub-checksum data have values different from each other. In other words, the sub-checksum data corresponding to LUT 'A' is different from the sub-checksum data corresponding to LUT 'B'. Also, total checksum data is stored at the last address of the memory.

Having described the exemplary embodiments of the display system according to the present invention, modifications and variations can be readily made by those skilled in the art in light of the above teachings. It is therefore to be understood that, within the scope of the appended claims, the present invention can be practiced in a manner other than as specifically described herein.

What is claimed is:

1. A display device for displaying images, comprising:

an image signal source unit which provides primary image data and a compensation data to compensate the primary image data which varies in response to a variation of ambient temperature of the display device; and a display unit which displays the images using compensated image data obtained by compensating the primary image data with the compensation data, wherein the display unit comprising a first switching part configured to transfer one of parallel compensation data and device compensation data associated with a characteristic of the display device from a first memory in response to a first clock signal.

2. The display device of claim 1, wherein the compensation is selected from a set of compensation data in response to a variation of ambient temperature of the display device.

3. The display device of claim 2, further comprising a temperature sensor detecting the variation of the ambient temperature of the display device and provide a temperature data corresponding to the variation of the ambient temperature.

4. The display device of claim 3, wherein the image signal source unit comprises:

a data processing part providing the primary image data to the display unit;

a second memory storing the set of compensation data, each compensation data of the set of compensation data associated with a corresponding temperature range; and a first controller to select the compensation data from the second memory in response to the temperature data from the temperature sensor and provide the selected compensation data to the display unit.

5. The display device of claim 4, wherein the set of compensation data is a plurality of look-up tables of compensation data and each look-up table of the plurality of look-up tables is associated with the corresponding temperature range.

6. The display device of claim 4, wherein the display unit further comprises:

a second controller receiving the primary image data from the data processing part and the selected compensation data from the first controller and generate the compensated image data by compensating the primary image data with the selected compensation data;

a data driver receiving the compensated image data and generate compensated driving voltage signals; and a display panel to receive the compensated driving voltage signals to display the images.

7. The display device of claim 6, further comprising a third memory storing the selected compensation data and the second controller reading the selected compensation data from the third memory to compensate the primary image data.

8. The display device of claim 7, wherein the second memory stores the selected compensation data such that a plurality of look-up tables of compensation data are each stored at corresponding address in the second memory and checksum data is assigned to each of the look-up tables.

9. The display device of claim 7, wherein the second controller comprises:

the first memory;

the first switching part;

a serial-parallel converting part converting the selected compensation data into the parallel compensation data; and a fourth memory storing an output of the first switching part in response to a second clock signal.

10. The display device of claim 9, wherein the first clock signal is a clock signal for transferring the selected compensation data from the third memory to the serial-parallel converting part.

11. The display device of claim 10, wherein the second controller further comprises;

a second switching part transferring one of a serial clock signal and a dot clock signal in response to the first clock signal; and a third switching part transferring one of an output of the second switching part and the dot clock signal in response to a clock signal associated with completion of transfer of the selected compensation data to the serial-parallel converting part, wherein an output of the third switching part is provided to the fourth memory as the second clock signal.

12. The display device of claim 6, wherein the second controller comprises:

the first memory;

the first switching part;

a serial-parallel converting part converting the selected compensation data into the parallel compensation data;

a buffer storing the parallel compensation data and transferring the parallel compensation data to the first switching part in response to a buffer control clock; and a fourth memory storing an output of the first switching part in response to a dot clock signal.

13. The display device of claim 12, wherein the first clock signal is a clock signal for transferring the selected compensation data from the third memory to the serial-parallel converting part.

14. The display device of claim 13, wherein the second controller further comprises;

a logic gate performing logic AND operation with respect to a vertical synchronizing signal of the display unit and a clock signal associated with completion of transfer of the selected compensation data to the serial-parallel converting part;

a second switching part transferring one of a serial clock signal and the dot clock signal in response to the first clock signal; and a third switching part transferring one of output of the second switching part and the dot clock signal in response to an output of the logic gate, wherein an output of the third switching part is provided to the buffer as the buffer control signal.

* * * * *